US008070151B2

(12) United States Patent
Lee et al.

(10) Patent No.: US 8,070,151 B2
(45) Date of Patent: Dec. 6, 2011

(54) SHEET PROCESSING APPARATUS AND SHEET PROCESSING METHOD

(75) Inventors: Chun-Kuan Lee, Hsinchu (TW); Yueh-Shing Lee, Hsinchu (TW); Shao-Yang Wu, Hsinchu (TW)

(73) Assignee: Foxlink Image Technology Co., Ltd., Hsinchu (TW)

( * ) Notice: Subject to any disclaimer, the term of this patent is extended or adjusted under 35 U.S.C. 154(b) by 215 days.

(21) Appl. No.: 12/647,420

(22) Filed: Dec. 25, 2009

(65) Prior Publication Data

US 2010/0258997 A1 Oct. 14, 2010

(30) Foreign Application Priority Data

Apr. 10, 2009 (TW) ..... 98112074 A

(51) Int. Cl.
*B65H 5/22* (2006.01)

(52) U.S. Cl. ..... 271/4.02; 271/10.02; 271/265.01

(58) Field of Classification Search ..... 271/4.02, 271/10.02, 265.01, 265.02, 3.15, 3.16, 121, 271/122; 399/370, 371, 376
See application file for complete search history.

(56) References Cited

U.S. PATENT DOCUMENTS

| | | | | |
|---|---|---|---|---|
| 6,695,301 | B1 * | 2/2004 | Tratar | 271/3.13 |
| 7,357,387 | B2 * | 4/2008 | Asada | 271/110 |
| 7,410,167 | B2 * | 8/2008 | Koga et al. | 271/266 |
| 7,621,518 | B2 * | 11/2009 | Iesaki et al. | 271/3.14 |
| 7,971,867 | B2 * | 7/2011 | Shiraiwa et al. | 271/10.01 |
| 2003/0156150 | A1 * | 8/2003 | Hayashi et al. | 347/19 |
| 2007/0284812 | A1 * | 12/2007 | Hirai | 271/265.01 |
| 2010/0270738 | A1 * | 10/2010 | Cheng | 271/265.01 |
| 2011/0101596 | A1 * | 5/2011 | Lee et al. | 271/3.16 |

* cited by examiner

*Primary Examiner* — Jeremy R Severson

(57) ABSTRACT

A sheet processing apparatus includes a sheet-table unit, a sheet-separating unit disposed at a downstream end of the sheet-table unit along a convey direction of the sheets, a convey unit arranged at a downstream end of sheet-separating unit, a discharge unit located at a downstream end of the convey unit, an sheet processing unit placed between the convey unit and the discharge unit, a speed sensor arranged at an upstream end of the sheet-separating unit for detecting a movement of each sheet for forming a sheet interval between two adjacent sheets, and an edge sensor located between the sheet-separating unit and the sheet processing unit. The edge sensor detects a front edge and a rear edge of each sheet passing therethrough, and sends corresponding control signals to a system controller which delays a predetermined time according to the control signals to control the sheet processing unit to start and stop processing.

11 Claims, 15 Drawing Sheets

SHEET PROCESSING APPARATUS AND SHEET PROCESSING METHOD

BACKGROUND OF THE INVENTION

1. Field of the Invention

This present invention relates to a sheet processing apparatus, and more specifically to a sheet processing apparatus having a feeding structure which improves the stability of sheet feeding and reduces the manufacture cost, and a sheet processing method.

2. The Related Art

Please refer to FIG. 1, a conventional sheet processing apparatus 100' comprises a sheet-conveying mechanism and an image-forming mechanism 5'. The sheet-conveying mechanism has a stacking plate 1' for holding sheets of paper 8', a sheet-separating unit 2', a convey unit 3', a discharge unit 6' and a discharge tray 7' for receiving the scanned sheets of paper 8'. The sheet-separating unit 2' includes a sheet-separating roller 21' and a retard pad 22' disposed above the sheet-separating roller 21', with a convey path formed therebetween. A pick spring 11' is arranged above the stacking plate 1' and adjacent to the retard pad 22' for pressing the sheets of the paper 8'. The sheet processing apparatus 100' further has a sensor 41' mounted to a bottom of the stacking plate 1', with a sensor arm swinging upwards for detecting whether there is any sheet of the paper 8' settled on the stacking plate 1', and a sensor 42' with a sensor arm, disposed between the sheet-separating unit 2' and the convey unit 3' for detecting whether one sheet of paper 8' passes therethrough.

When the sheet processing apparatus 100' is in work, the sheets of paper 8' are put on the stacking plate 1', pressing the sensor arm of the sensor 41' downwards. The sheet-separating roller 21' has a frictional outer peripheral surface to feed a lowermost sheet of paper 8' forwards, cooperating with the retard pad 22'. The lowermost sheet, designated 81', is conveyed forwards with a linear speed V1 before caught by a convey roller 31' of the convey unit 3'. The sensor arm of the sensor 42' is pushed upwards by the moving sheet 81' to generate a signal sent to a system controller. The image-forming mechanism 5' is commanded accordingly by the system controller to start scanning at a proper time. The outer peripheral linear speed of the convey roller 31' and a discharge roller 61' of the discharge unit 6' are V2, correspondingly, when the sheet 81' is conveyed forward by the convey unit 3', it is moving at the linear speed V2 because the force acted on the sheet 81' from the convey unit 3' is greater than that from the sheet-separating unit 2', until the sheet 81' is received in the discharge tray 7'. During this period, when the sheet 81' leaves off the sheet-separating unit 2', a sheet above the sheet 81', designated 82', comes into contact the sheet-separating roller 21' and is urged to move forward at the linear speed V1. Since the linear speed V2 is faster than the linear speed V1, the sheet 82' is spaced away from the sheet 81' with an increasing gap formed between the two adjacent sheets of paper. As a result, when the sheet 81' is apart from the sensor 42', the sensor arm of the sensor 42' returns the original position before being pushed upward by the subsequent sheet 82', and generates another signal sent to the system controller. The image-forming mechanism 5' is commanded by the system controller to stop scanning of sheet 81' at a proper time. The image-forming mechanism 5' is controlled to set the start time and the end time of scanning each sheet according to the two different signals caused by the gaps between the sheets of paper, thereby obtaining the scanned images of each sheet of paper.

However, since the linear speed V2 is faster than the linear speed V1, the convey roller 31' will pull and drag the sheet of paper which is partly restrained between the sheet-separating roller 21' and the retard pad 22', which will affect the conveying stability of the sheets of paper, or even damage the sheets of paper. Consequently, it affects the quality of the scanned image. Furthermore, the convey roller 31' is applied with a backward pulling force from the sheet-separating unit 2' via the sheet of paper, which increases the load of the stepping motor which drives the convey roller 31', and influences the processing efficiency of the sheet processing apparatus 100'.

SUMMARY OF THE INVENTION

An object of the invention is to provide a sheet processing apparatus having a feeding structure which improves the stability of sheet feeding. The sheet processing apparatus includes a sheet-table unit for holding a plurality of sheets, a sheet-separating unit disposed at a downstream end of the sheet-table unit along a convey direction of the sheets, for separating the sheets one by one and feeding the sheets downstream, a convey unit arranged at a downstream end of the sheet-separating unit along the convey direction of the sheets, for feeding the sheets downstream stably, a discharge unit located at a downstream end of the convey unit along the convey direction of the sheets, for discharging the sheets, a sheet processing unit placed between the convey unit and the discharge unit, and close to a convey path of the sheets, for processing the sheets, a speed sensor arranged at an upstream end of the sheet-separating unit, and close to the convey path, and an edge sensor located between the sheet-separating unit and the sheet processing unit. The speed sensor is capable of detecting the leaving time of each sheet therefrom, and sending corresponding signal to a system controller which controls the sheet-separating unit to stop and start feeding the sheets forward, for forming a sheet interval between the two adjacent sheets on the convey path. The edge sensor is capable of detecting a front edge and a rear edge of each sheet passing therethrough, and sending corresponding control signals to the system controller which delays a predetermined time according to the received signals from the edge sensor to control the sheet processing unit to start and stop processing each sheet which is moving on the convey path at an even speed.

Another object of the invention is to provide a sheet processing method. The sheet processing method for at least one sheet comprises the steps of:

a. separating and transporting the plural sheets placed on a sheet-table unit one by one along a convey path at an even speed by a sheet-separating unit;

b. detecting the time at which a front edge of each sheet activates an edge sensor and sending a corresponding signal to the system controller by the edge sensor;

c. receiving the signal sent by the edge sensor when the front edge of the sheet activates the edge sensor and calculating the time of the sheet arriving at a sheet processing unit on the basis of the received signal, and then controlling the sheet processing unit to start processing the sheet at the time by the system controller;

d. detecting the time of each sheet leaving a speed sensor and sending a corresponding signal to a system controller by the speed sensor;

e. calculating the time of the proceeding sheet departing from the sheet-separating unit on the basis of the received signal from speed sensor, and then controlling the sheet-separating unit to stop feeding the sheets forward and operate again at proper times by the system controller;

f. detecting the time of a rear edge of each proceeding sheet apart from the edge sensor and sending a corresponding signal to the system controller by the edge sensor;

g. receiving the signal sent by the edge sensor when the rear edge of the sheet departs from the edge sensor, and calculating the time of the sheet leaving the sheet processing unit on the basis of the received signal, and then controlling the sheet processing unit to stop processing at the time by the system controller; and h. discharging the proceeding sheet by a discharging unit commanded by the system controller.

As described above, the sheet processing apparatus is provided with the speed sensor for detecting the movement of each sheet and sending the corresponding signals to the system controller, and the edge sensor for sensing the front edge and the rear edge of each sheet and sending the corresponding signals to the system controller. The system controller receives the signals from the speed sensor to determine the motion state of the sheets, and control the sheet-separating unit to stop running at a proper time for forming the sheet interval under the condition of the sheets conveyed at the even speed. The system controller delays the predetermined times according to the signals from the edge sensor to control the operation of the sheet processing unit. Therefore, the sheet processing apparatus not only separates the obtained image of each sheet, without pulling and dragging the conveying sheets so as to affect the conveying stability of the sheets, but also improves the quality and efficiency of processing the sheets.

BRIEF DESCRIPTION OF THE DRAWINGS

The invention, together with its object and the advantages thereof may be best understood by reference to the following description taken in conjunction with the accompanying drawings, in which.

DETAILED DESCRIPTION OF THE EMBODIMENTS

Figure 1:
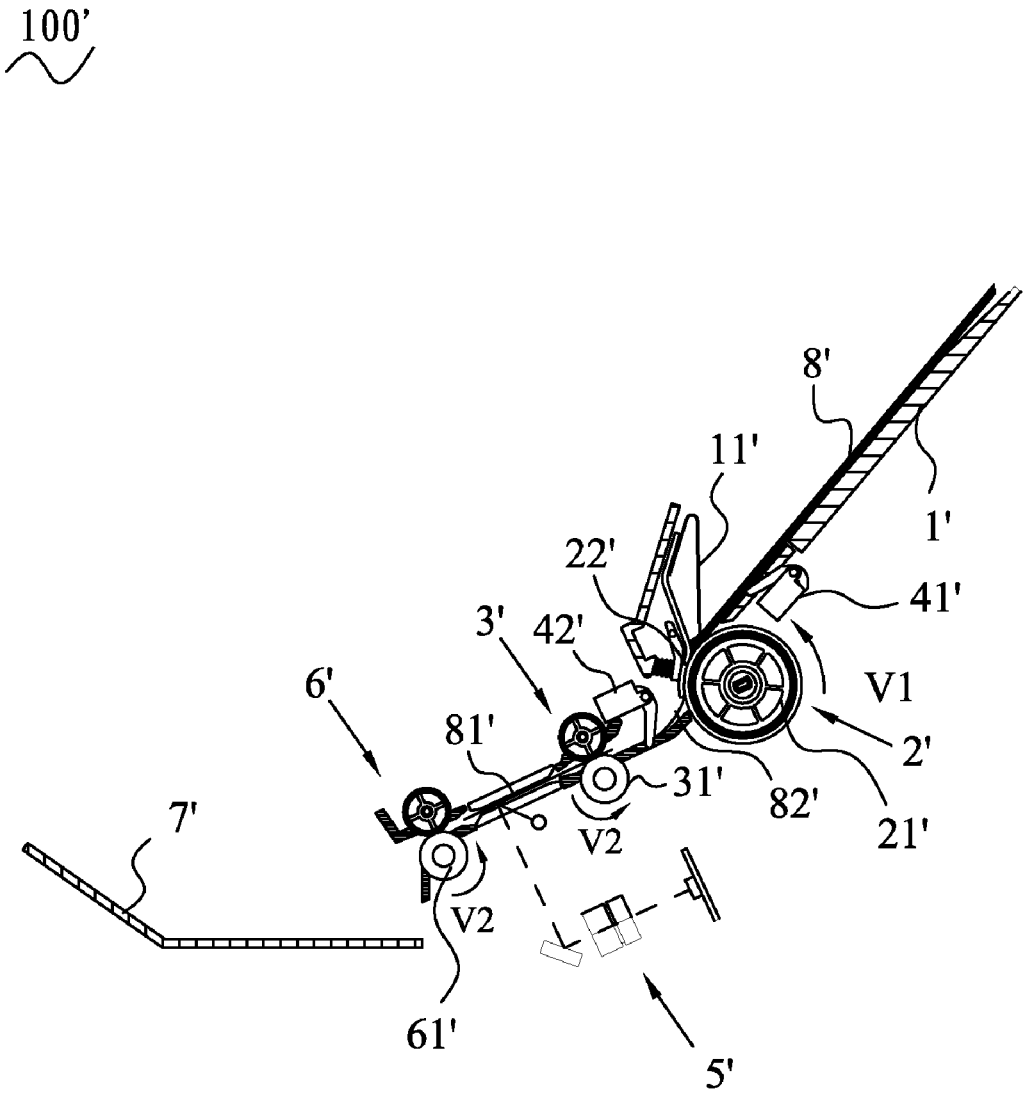
FIG. 1 (Prior Art)
FIG. 1 is a schematic sectional view of a sheet processing apparatus in prior art.
Figure 2:
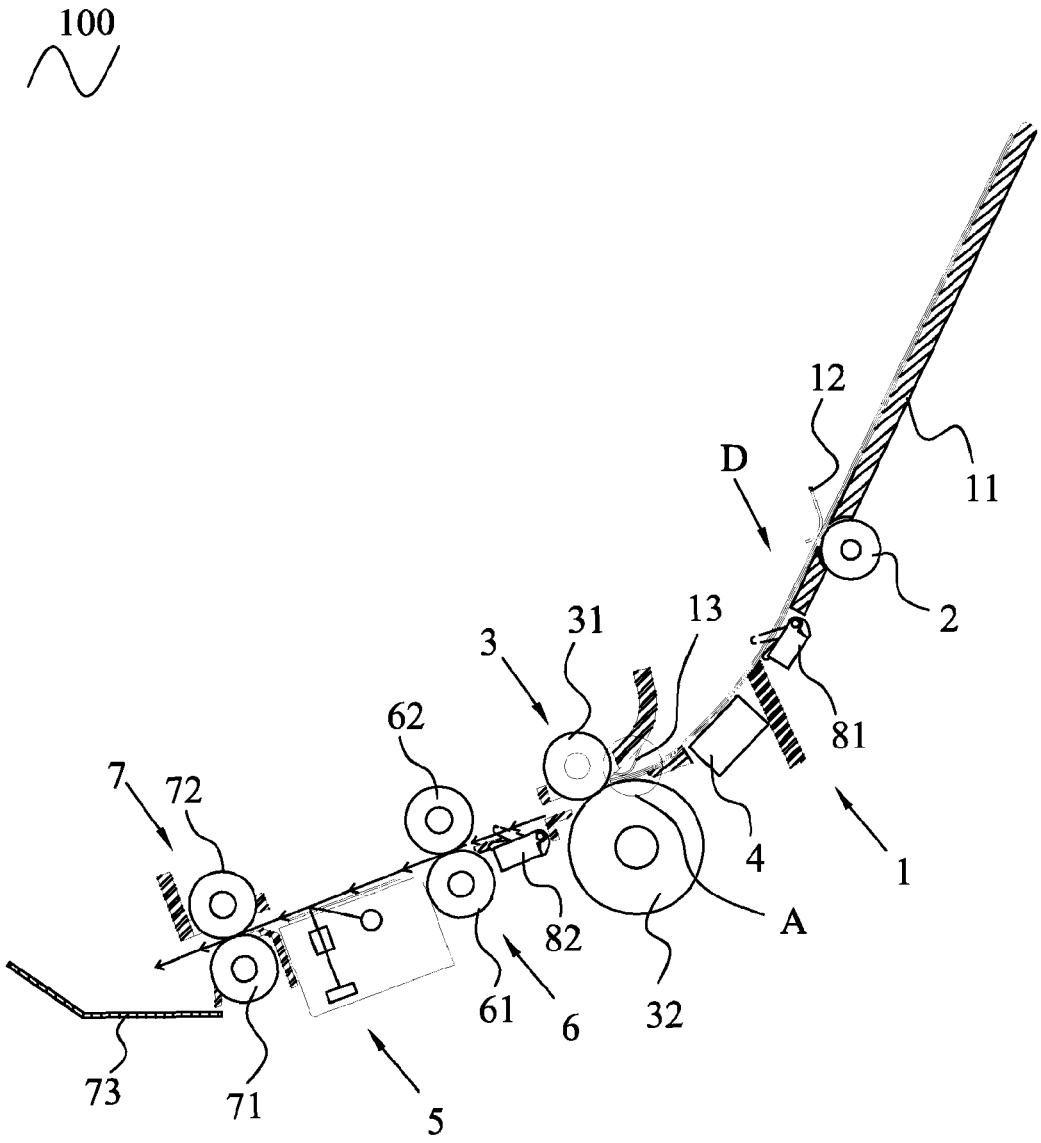
FIG. 2 is a schematic sectional view of a sheet processing apparatus according to a first embodiment of the present invention.
Figure 3:
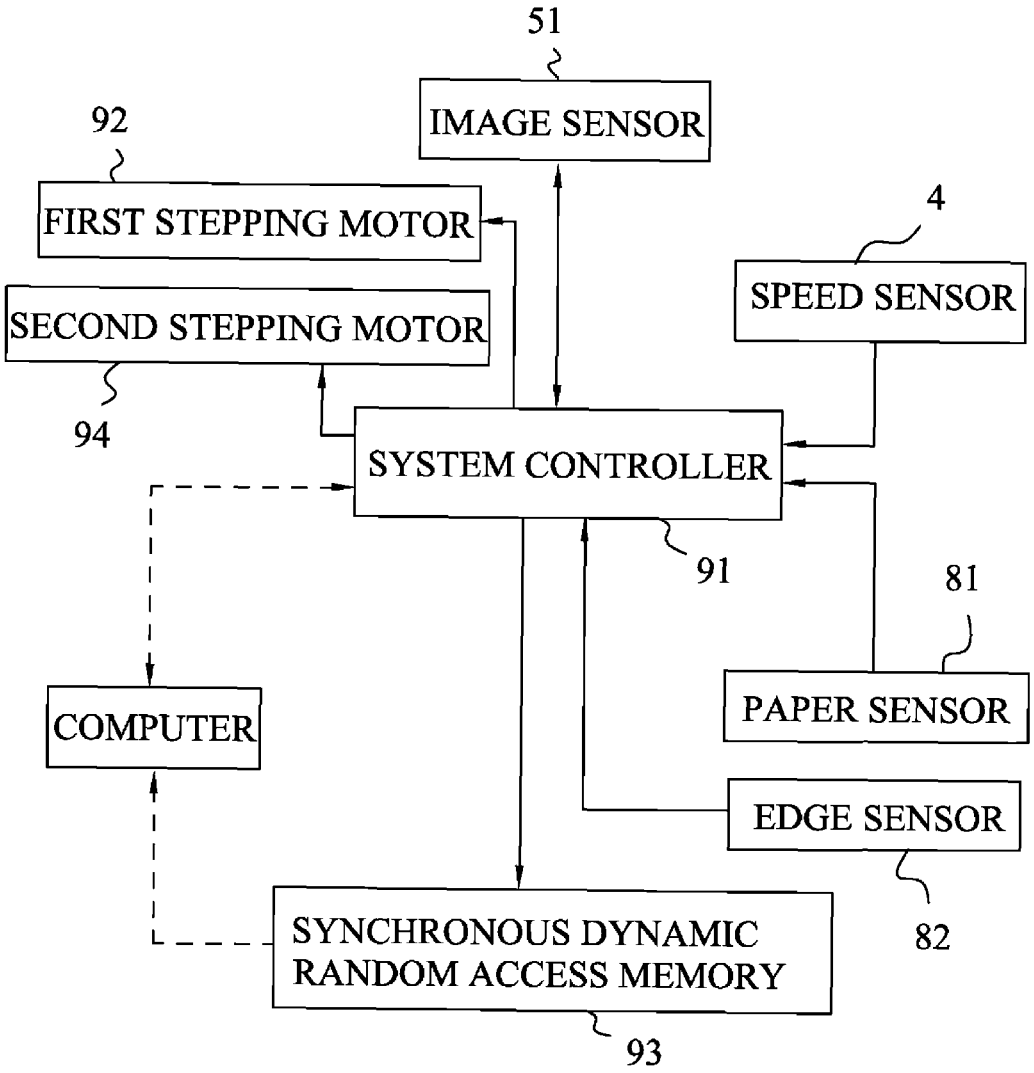
FIG. 3 is a control block diagram for the sheet processing apparatus shown in FIG. 2.
Figure 4:
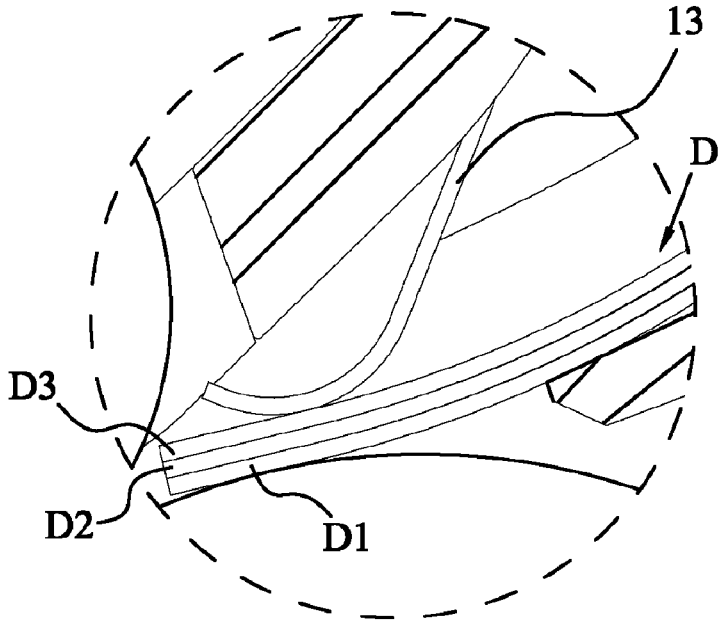
FIG. 4 is a partly enlarged view showing an enlarged portion A of FIG. 2.
Figure 5:
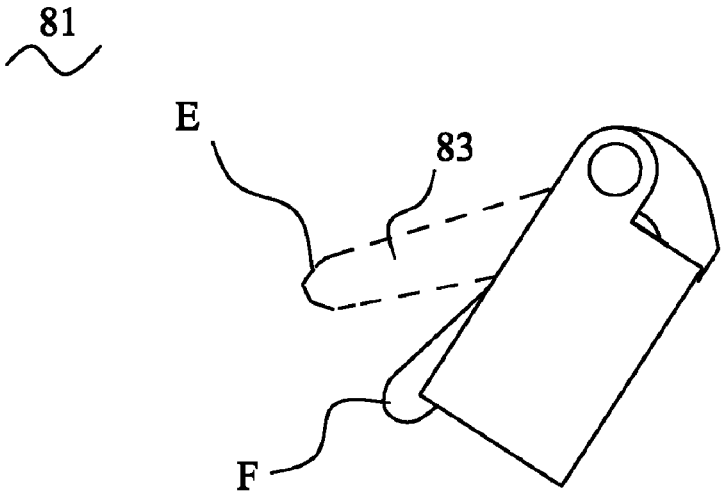
FIG. 5 is a schematic sectional view illustrating the position change of a sensor arm of a paper sensor shown in FIG. 2.
Figure 6:
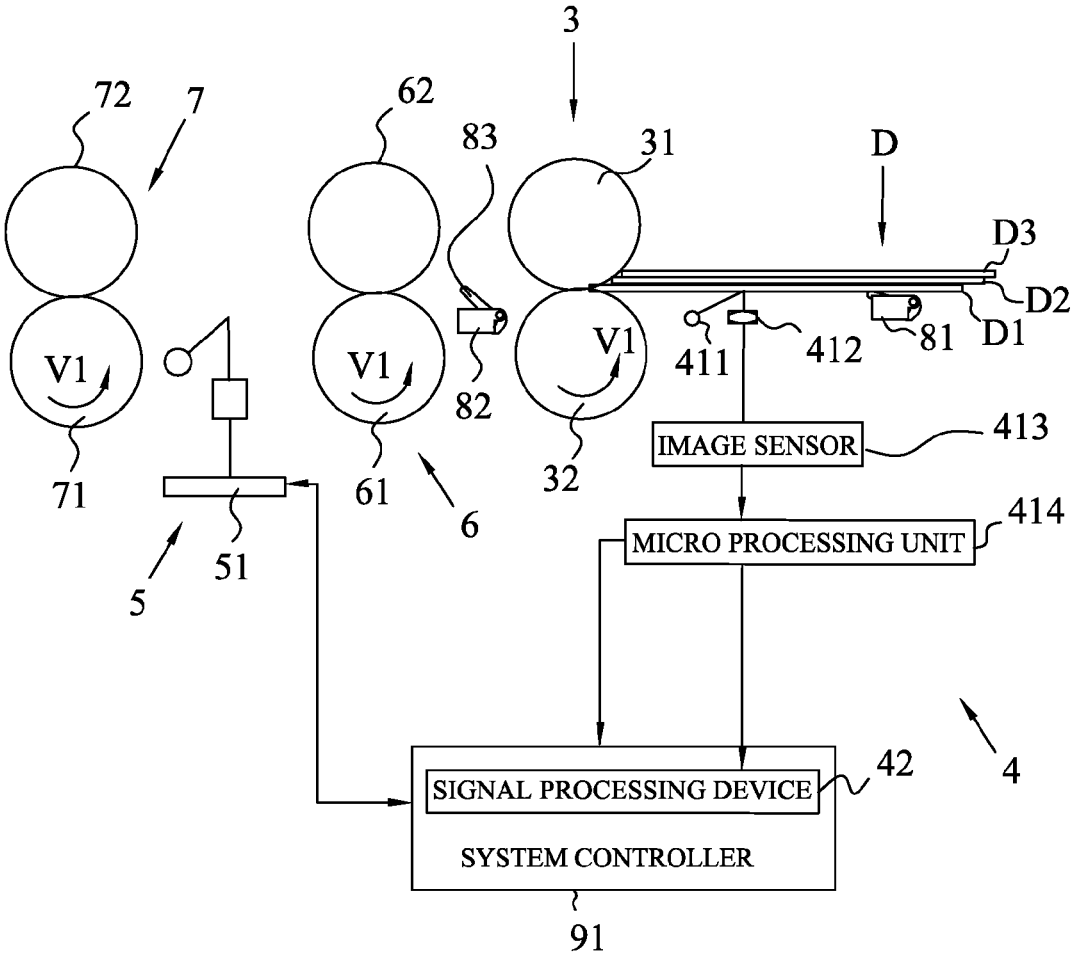
FIGS. 6-15 are schematic sectional views illustrating the different states of sheets in the conveying process of the sheet processing apparatus shown in FIG. 2.
Figure 7:
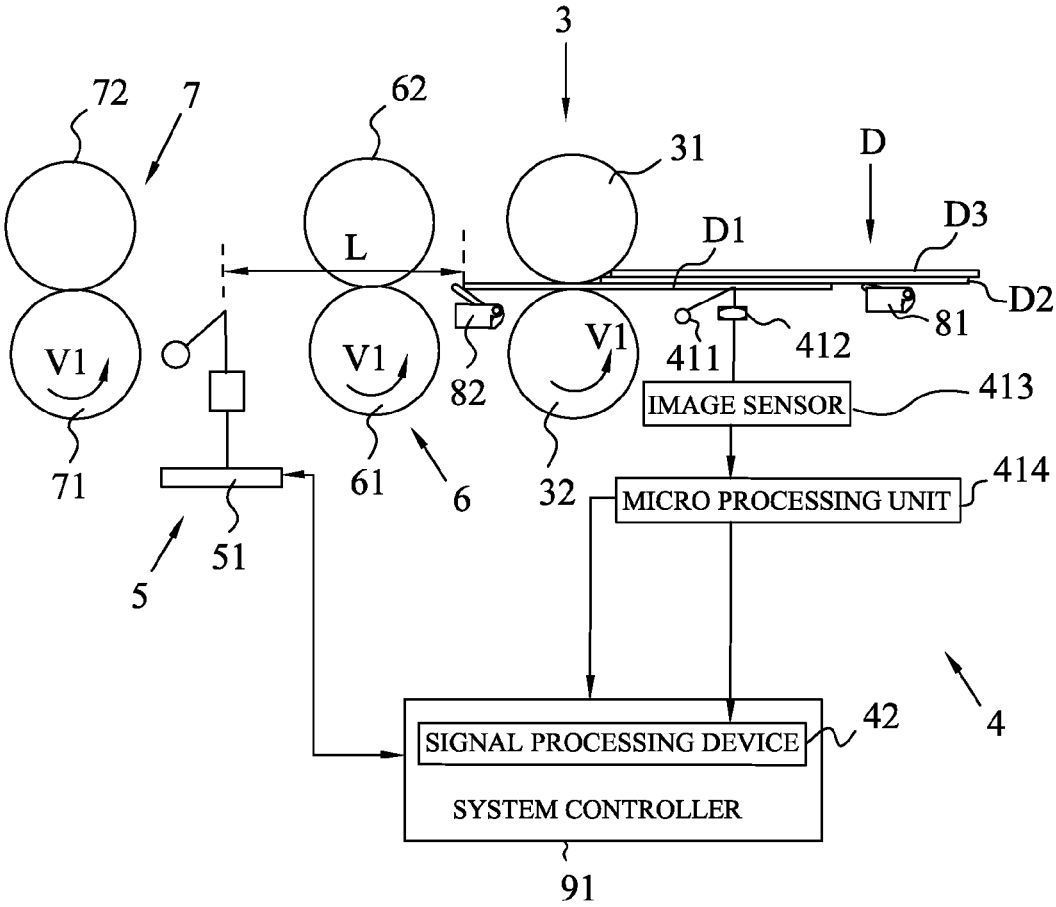
Figure 8:
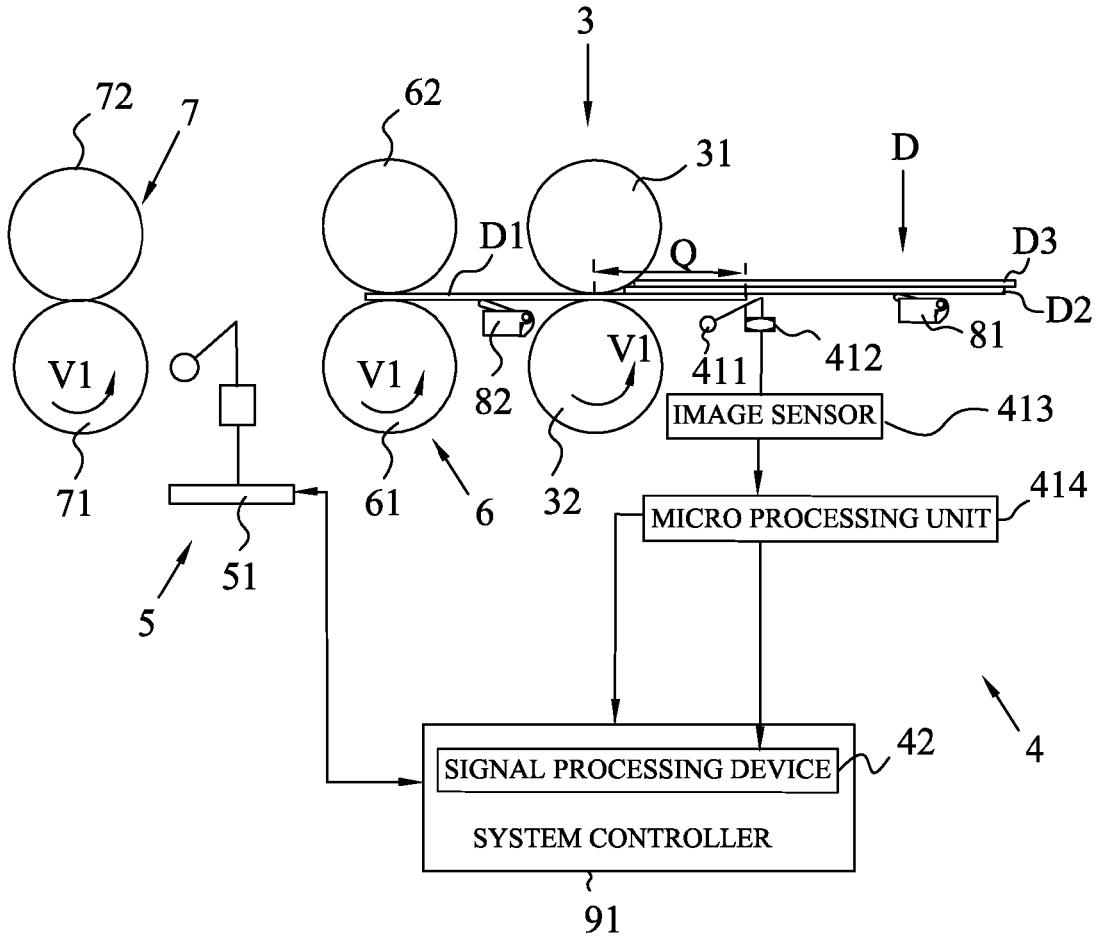
Figure 9:
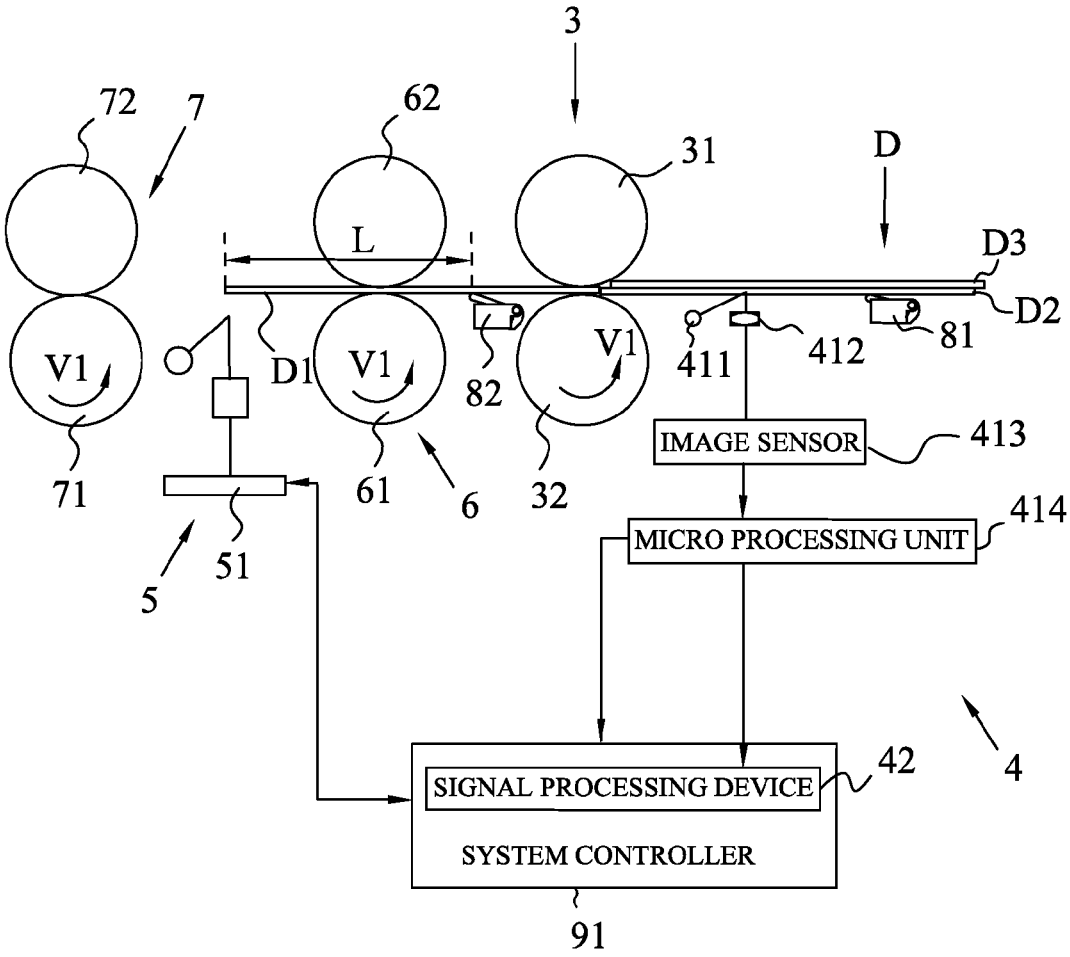
Figure 10:
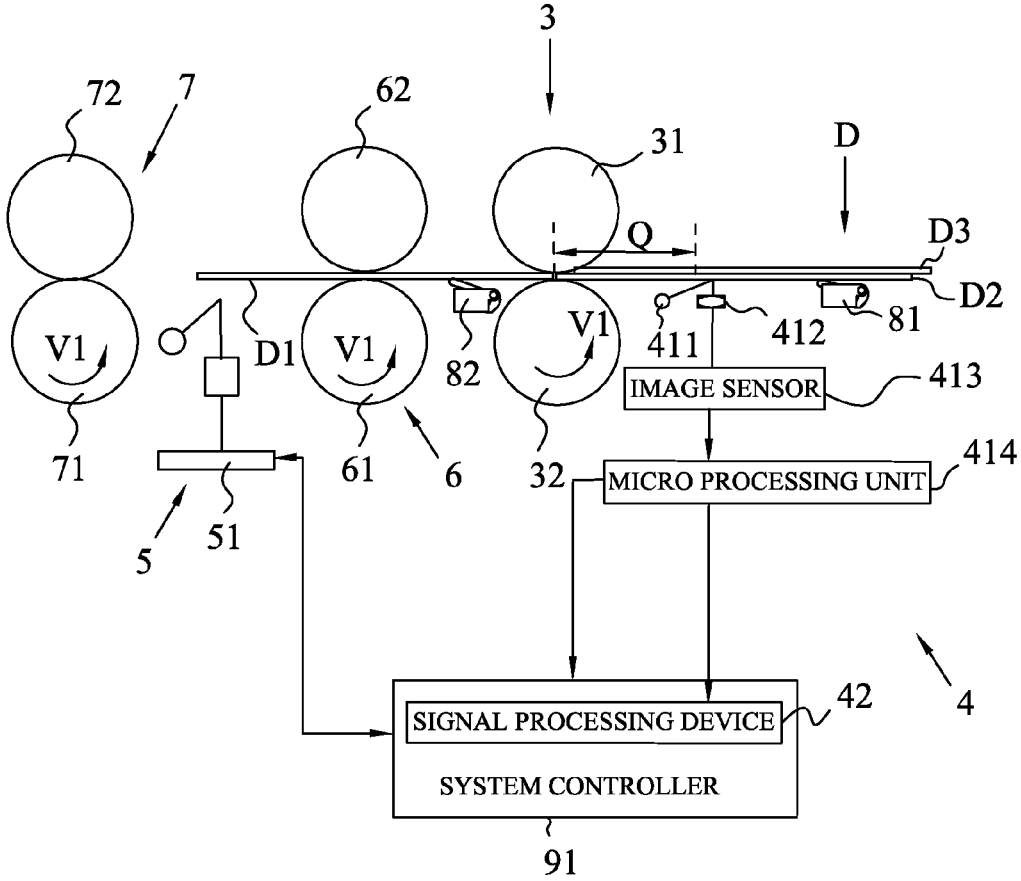

Referring to FIGS. 2-4, a sheet processing apparatus 100 of the first embodiment according to the present invention is shown. The sheet processing apparatus 100 comprises a sheet-table unit 1, a sheet-separating unit 3, a speed sensor 4 connected with a system controller 91, usually an integrated circuit (IC), a sheet processing unit 5 having an image sensor 51 (see FIG. 6) connected with the system controller 91, a convey unit 6, a discharging unit 7, a paper sensor 81 and an edge sensor 82 connected with the system controller 91, a first and second stepping motors 92, 94 controlled by the system controller 91, and a synchronous dynamic random access memory (SDRAM) 93 connected with the system controller 91. The sheet processing apparatus 100 is capable of connecting with a computer for outputting image data or information exchange.

The sheet-table unit 1 has a stacking plate 11, a first pick spring 12 and a second pick spring 13. The stacking plate 11 is obliquely mounted to a housing (not shown) of the sheet processing apparatus 100. A plurality of sheets D is placed on the stacking plate 11. A pick roller 2, which is driven by the first stepping motor 92, is mounted in the stacking plate 11. The pick roller 2 has an outer peripheral surface, maybe coated by rubber, having relatively high friction coefficient, and serves to feed the plural sheets D towards the sheet-separating unit 3 located at a downstream end of the stacking plate 11. The first pick spring 12 and the second pick spring 13 are respectively arranged over the pick roller 2 and adjacent to the sheet-separating unit 3, used to press the sheets D for guiding the sheets D to enter a nip area of the sheet-separating unit 3 smoothly.

With reference to FIGS. 2-6, the paper sensor 81 and the speed sensor 4, are disposed at the upstream end of the sheet-separating unit 3, and close to a convey path of the sheets D. The paper sensor 81 has a sensor arm 83 which is pressed downwards by the sheets D from a position E to a position F and automatically returns the original position E when the sheets D are departed therefrom. The paper sensor 81 sends different signals to the system controller 91 when the sensor arm 83 is located at different positions (the position E and the position F). The speed sensor 4 is used for detecting the moving state of the closest one of the plural sheets D to it, and sending information to a signal processing device 42 which is integrated into the system controller 91 in this embodiment. The speed sensor 4 comprises an illumination 411, a lens 412, an image sensor 413 and a micro processing unit 414. The illumination 411 for illuminating the surface of the closest sheet D can be a LED. In this embodiment, the illumination 411 is the red LED. The lens 412 is disposed at a side of the illumination 411 for collecting the reflected light from the closest sheet D to form images on the image sensor 413. The image sensor 413 records the images of the sheets D successively and sends the images to the micro processing unit 414. The micro processing unit 414 receives and processes the images and analyzes the variation of distinguishing features between the two successive images to determine the moving velocity at two coordinates, designated X coordinate and Y coordinate, meanwhile, sends related information to the signal processing device 42 and the system controller 91. The signal processing device 42 is capable of comparing the received values of velocity to the predetermined values set therein to judge weather the closest sheet D is moving sufficiently, without the seldom move resulted from an unexpected shake or other factors. The system controller 91 receives the results of comparison from the signal processing device 42 for obtaining the moving status of the closest sheet D.

Please refer to FIGS. 2-3, the sheet-separating unit 3 is placed at the downstream end of the stacking plate 11, and has a separating roller 32 driven by the first stepping motor 92 and a retard roller 31 above the separating roller 32, with the nip area formed therebetween. A friction coefficient between the separating roller 32 and the sheet D is larger than that between the retard roller 31 and the sheet D, for feeding each of the plural sheets D forwards. The friction coefficient between the retard roller 31 and the sheet D is larger than that between the two adjacent sheets D, for stopping the plural sheets D from moving forwards except for the lowermost one. Herein, the retard roller 31 can be replaced by a retard pad. The convey unit 6 is located at the downstream end of and spaced away from the sheet-separating unit 3 with a predetermined distance, and has a convey roller 61 driven by the second stepping motor 94 and a convey pulley 62 above the convey roller 61. The discharge unit 7, which includes a discharge roller 71, a discharge pulley 72 above the discharge roller 71, and a discharge tray 73 located downstream of the discharge roller 71 and the discharge pulley 72, is disposed at the downstream end of the convey unit 6 and spaced away from the edge sensor 82 with a predetermined distance. The discharge roller 71 is driven by the second stepping motor 94 and brings the discharge pulley 72 to rotate in use. The plural sheets D are discharged to the downstream discharge tray 73 one by one through a nip area between the discharge roller 71 and the discharge pulley 72. The sheet processing unit 5 is located between the convey unit 6 and the discharge unit 7, and beneath the convey path of the plural sheets D. Of course, the sheet processing unit can also be arranged above the convey path of the plural sheets D, or there are two the sheet processing units respectively arranged at two opposite sides of the convey path. The image sensor 51 of the sheet processing unit 5 is linked to the system controller 91 for being controlled to scan the conveying plural sheets D.

The edge sensor 82 with the structure as the same as the paper sensor 81 is located between the sheet-separating unit 3 and the convey unit 6. When a front edge of the moving sheet D presses a sensor arm 83 of the edge sensor 82 downwards, the edge sensor 82 is capable of sending a control signal to the system controller 91. The system controller 91 calculates the time of the front edge of the sheet D arriving at a scanning line of the sheet processing unit 5 based on the received control signal, and controls the sheet processing unit 5 to start scanning the sheet D at a proper time. When a rear edge of the moving sheet D is apart from the sensor arm 83, the sensor arm 83 automatically returns the original position. Accordingly, the edge sensor 82 sends another control signal to the system controller 91. The system controller 91, according to the received control signal, delays a predetermined time to control the sheet processing unit 5 to stop scanning.

Please refer to FIG. 2 and FIGS. 6-11, the plural sheets D are put on the stacking plate 11, with tip ends thereof against the retard roller 31 and the separating roller 32. Herein, the sheets D are defined as a first sheet D1, a second sheet D2 and a third sheet D3, in an upward direction from a bottom thereof. When the sheet processing apparatus 100 is in work, the separating roller 32, the convey roller 61, and the discharge roller 71 are rotated anticlockwise with an outer peripheral linear speed V1. The separating roller 32 feeds the first sheet D1 forwards to enter the nip area. As the friction coefficient between the separating roller 32 and the first sheet D1 is larger than that between the retard roller 31 and the first sheet D1, and the friction coefficient between the retard roller 31 and the first sheet D1 is larger than that between two adjacent sheets D, the first sheet D1 is moved forward, but, the second sheet D2 and the third sheet D3 are stopped by the retard roller 31, thereby separating the plural sheets D one by one.

The front end of the first sheet D1 is conveyed and presses the sensor arm 83 of the edge sensor 82 downwardly. This time point is defined as $t_1$, accordingly, the system controller 91 receives a control signal from the edge sensor 82. Supposing a length between the pressing point of the sensor arm 83 of the edge sensor 82 and the scanning line of the sheet processing unit 5 is designated L, the front end of the first sheet D1 arrives at the scanning line of the sheet processing unit 5 through a time course L/V1 (designated a time course as T1) after $t_1$, defined as a time point $t_3$. The system controller 91 accordingly sets the delaying time course T1 based on the control signal to control the sheet processing unit 5 to start scanning at the time point $t_3$.

In this process, after the first sheet D1 moves for a short period of time, a rear end of the first sheet D1 is apart from the speed sensor 4. As the second sheet D2 is still in static, the speed sensor 4 detects the state variation from the first sheet D1 to the second sheet D2 and sends a corresponding control signal to the system controller 91, with this time point defined as $t_2$. Herein, a length between the speed sensor 4 and the nip area center of the separation unit 3 is designated Q. When the control signal resulted from the first sheet D1 departing from the speed sensor 4 is sent to the system controller 91, after a time course Q/V1 (designated T2), the rear end of the first sheet D1 passes through the nip area center of the separation unit 3. That is to say, the first sheet D1 departs from the separation unit 3, with this time defined as $t_4$. The system controller 91 controls the first stepping motor 92 to stop the separating roller 32 from rotation for a moment, and controls the separating roller 32 to start rotating again when the rear edge of the first sheet D1 is apart from the edge sensor 82 (or after a predetermined time). Thus a sheet interval is formed between the first sheet D1 and the second sheet D2 for making the edge sensor 82 to distinguish the front edge and the rear edge of the sheets D passing therethrough. Herein, the first stepping motor 92, which is used to drive the separating roller 32, can be replaced by a clutch. The clutch is connected between the second stepping motor 94 and the separating roller 32 and controlled by the system controller 91 to determine the motion of the separating roller 32, served as a switch.

Figure 11:
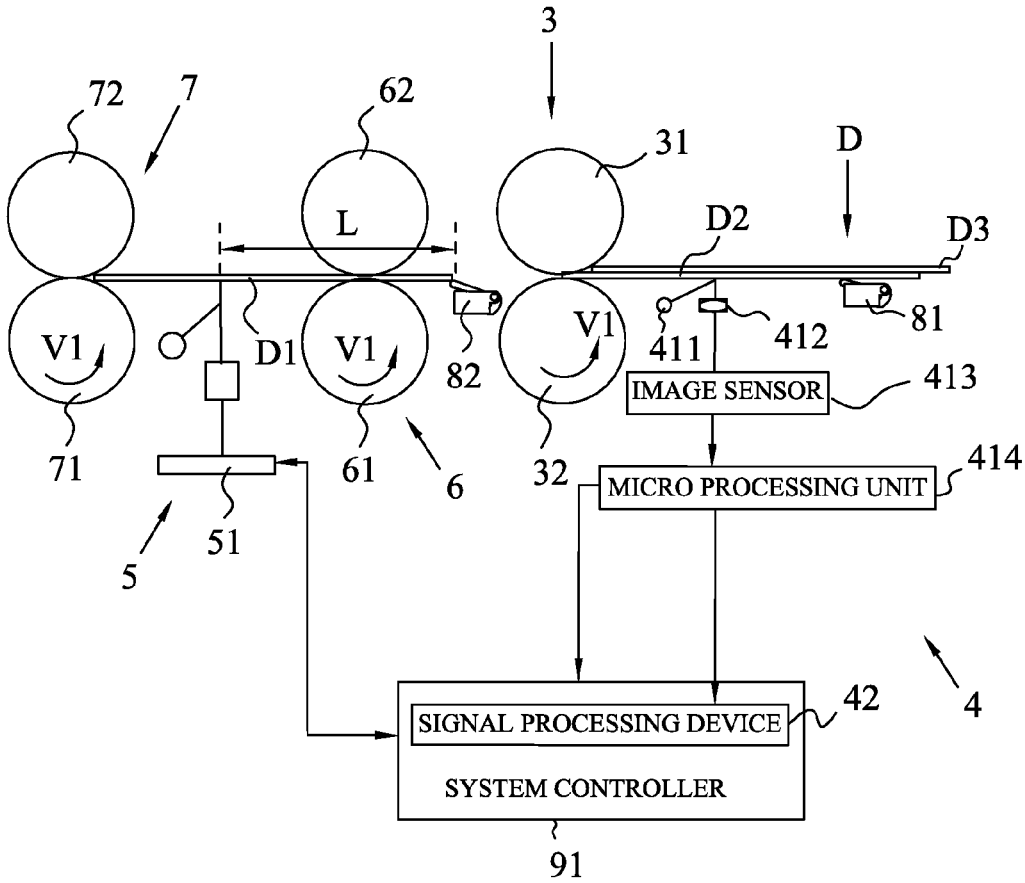
Figure 12:
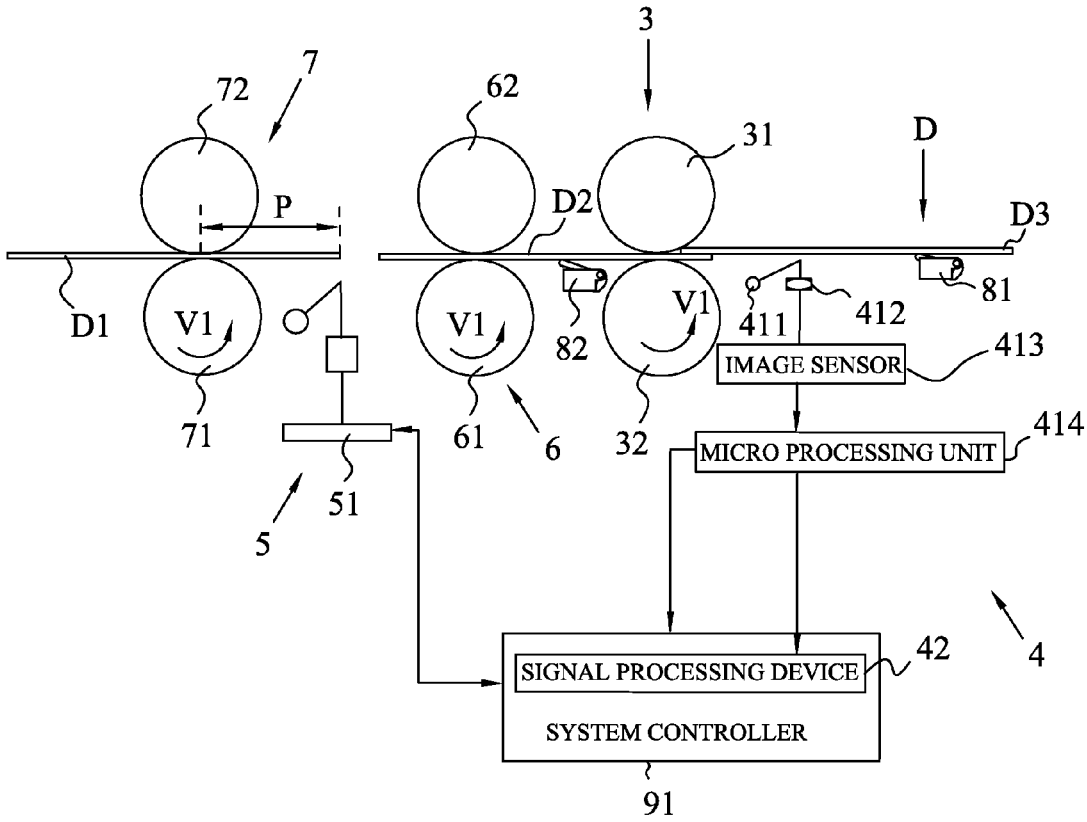

With reference to FIGS. 11-12, the rear end of the first sheet D1 departs from the pressing point of the sensor arm 83 of the edge sensor 82, the sensor arm 83 returns automatically the original position E, and the edge sensor 82 generates a control signal sent to the system controller 91, with this time point defined as $t_5$. The sheet processing unit 5 is commanded by the system controller 91 to stop scanning through the time course T1 after the time point $t_5$, with this time point defined as $t_6$. The first sheet D1 is finished scanning and conveyed by the discharge roller 71 to the discharge tray 73. The scanning time of the first sheet D1 is from the time point $t_3$ to the time point $t_6$, referred to as a total time course T, correspondingly, the system controller 91 processes the image scanned in the total time course T as the image of the first sheet D1, and sends the image to the computer via the SDRAM 93. In the same way, the image of the second sheet D2, as well as other sheets, can be acquired by this procedure.

Figure 13:
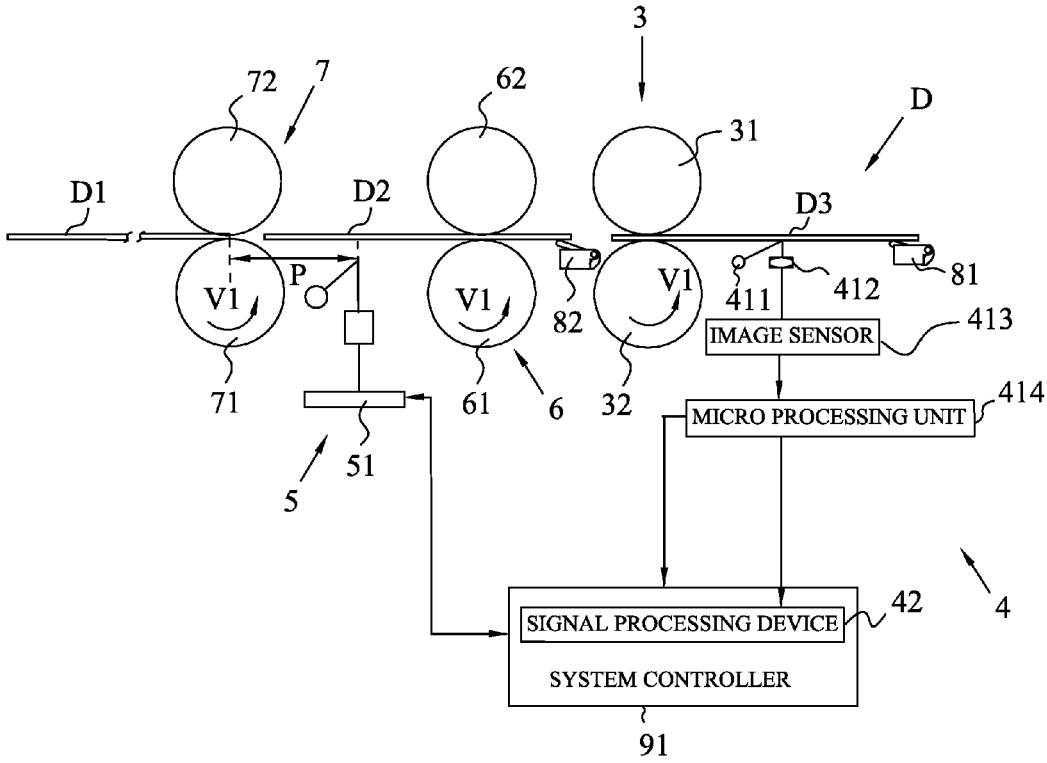
Figure 14:
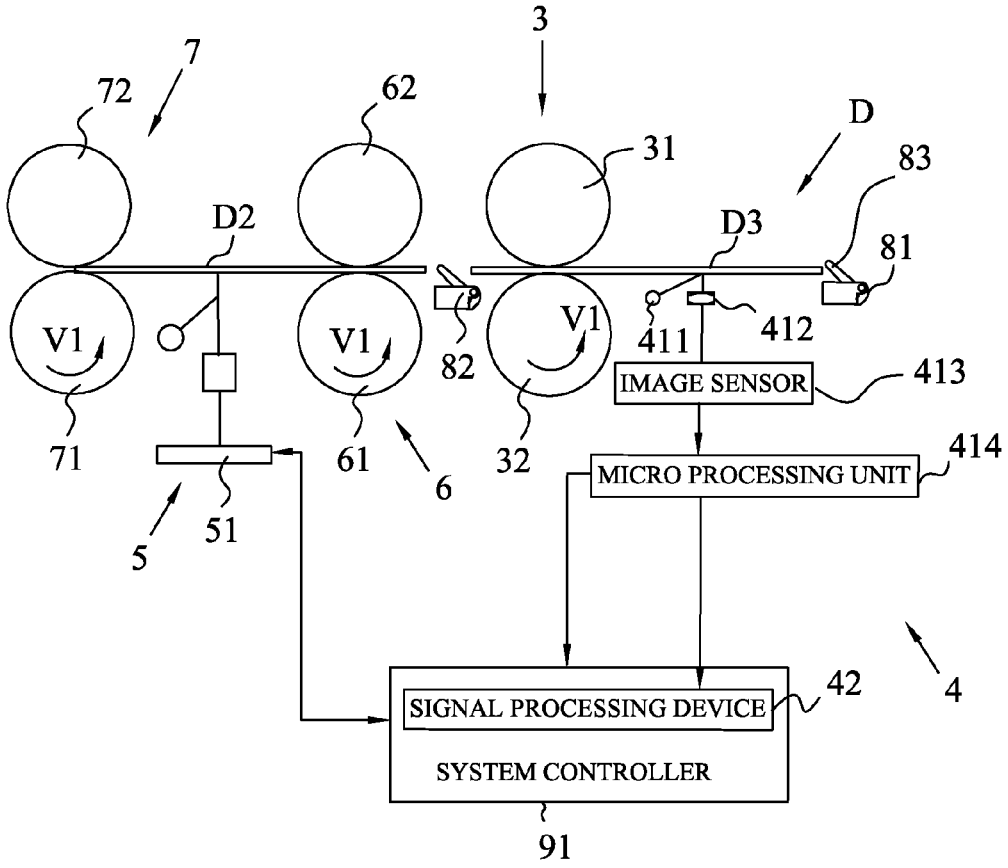
Figure 15:
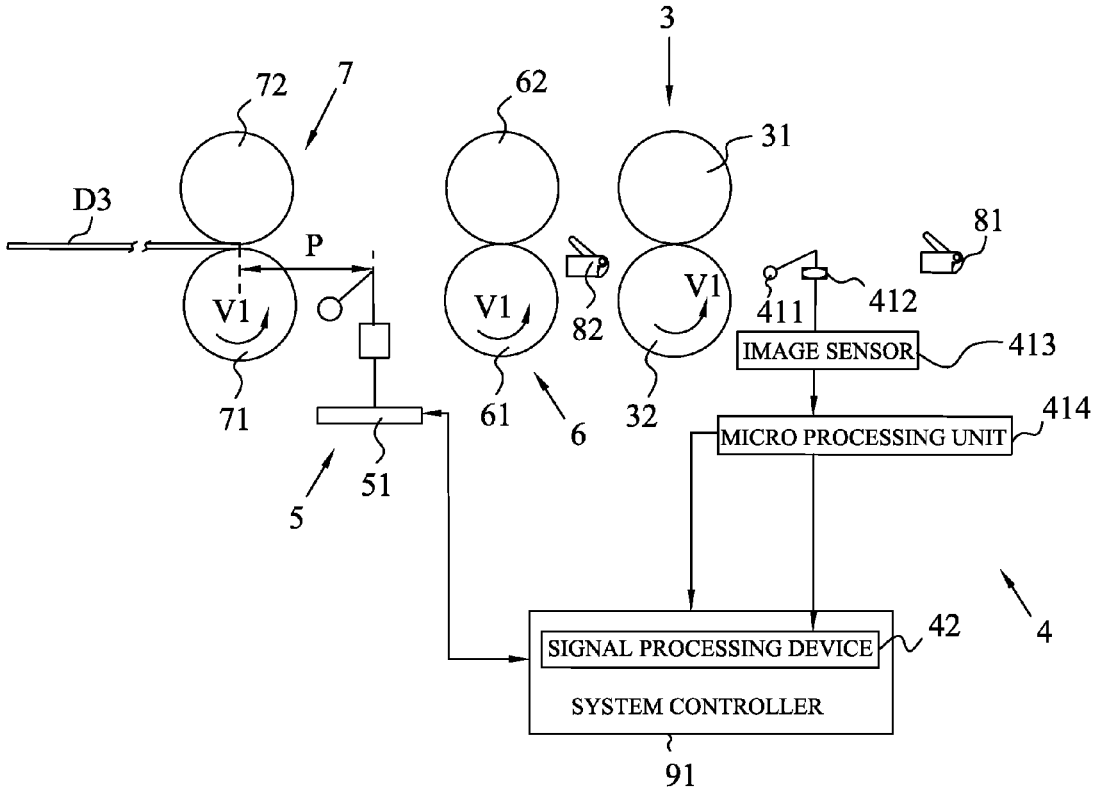

Referring to FIGS. 13-15, when the third sheet D3, the last sheet, is apart from the paper sensor 81, the sensor arm 83 swings to return the original position E. The paper sensor 81 sends a signal to the system controller 91, informing no sheets stacked on the stacking plate 11. The rear end of the third sheet D3 is conveyed and leaves the scanning line of the sheet processing unit 5, with this time point defined as $t_7$. The sheet processing unit 5 is controlled by the system controller 91 to stop scanning at the meantime. Supporting a length from the scanning line of the sheet processing unit 5 to the nip area center between the discharge roller 71 and the discharge pulley 72 is defined as a length P, the third sheet D3 is released from the discharge roller 71 and the discharge pulley 72 through a length of time P/V1 (designated a time course T3) after $t_7$ and received in the discharge tray 73. Meanwhile, the system controller 91 will send a control signal to the second stepping motor 94 for stopping working Normally, the system controller 91 sends the stopping signal to the second stepping motor 94 after more than the time T3, for guaranteeing the third sheet D3 to discharge from the discharge roller 71 and the discharge pulley 72.

Figure 16:
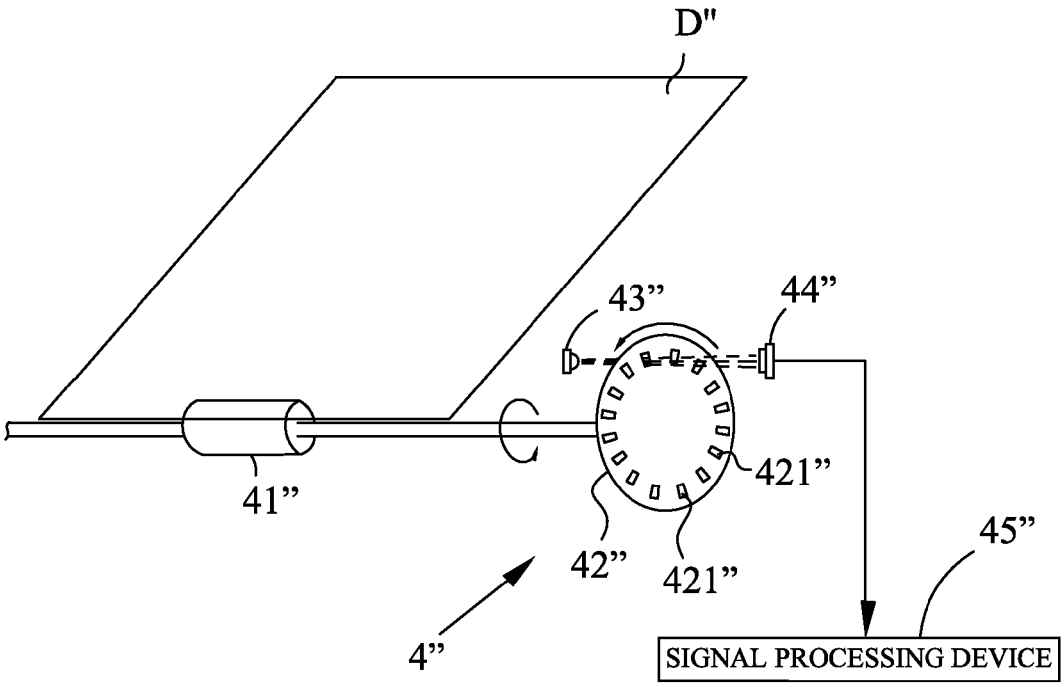
FIG. 16 is a schematic sectional view of a sheet processing apparatus according to a second embodiment of the present invention.

Please refer to FIG. 2 and FIG. 16, a sheet processing apparatus in accordance with the second embodiment of the present invention is illustrated. In comparison with the first embodiment of the present invention, the structure of the sheet processing apparatus is the same as that of the sheet processing apparatus 100 except for the speed sensor 4". The speed sensor 4" comprises a roller 41", a time disc 42", a photo interrupter sensor and a signal processing device 45". The roller 41" is located beneath the convey path and contacts the bottom of the lowermost sheet D". The time disc 42", made from lightproof material, is mounted on the roller 41" and rotated with the rotating roller 41". A plurality of openings 421" is formed at the time disc 42" at equal intervals, adjacent to an outer edge of the time disc 42" to show a ring shape.

The photo interrupter sensor has an LED 43", which is at a side of the time disc 42", and a receiver 44", which is disposed at the other side of the time disc 42". The LED 43", one of the openings 421" and the receiver 44" are aligned with one another. Thus the receiver 44" receives light emitted from the LED 43" through the opening 421". When the separating roller feeds the lowermost sheet D" forwards, the roller 41" is driven to rotate because of the friction between the lowermost sheet D" and the roller 41". As time disc 42" is rotated with roller 41", the receiver 44" regularly receives the light from the LED 43" through the openings 421", and sends two alternate signals to the signal processing device 45". When receiving the alternate control signals from the receiver 44", the signal processing device 45" will send a control signal to the system controller for informing that the lowermost sheet D" is moving. When receiving a constant signal from the receiver 44", the signal processing device 45" will send another control signal to the system controller, informing that the lowermost sheet D" is in static.

As described above, the sheet processing apparatus is provided with the speed sensor for detecting the movement of the lowermost sheet and sending the corresponding signals to the system controller, and the edge sensor for sensing the front edge and the rear edge of each sheet and sending the corresponding signals to the system controller. The system controller receives the signals from the speed sensor to determine the motion state of the sheets, and control the separating roller to stop and start rotating at a proper time, for forming the sheet interval under the condition of the sheets conveyed at the even speed. The system controller delays the predetermined times according to the signals from the edge sensor to control the operation of the sheet processing unit and the stepping motors. Therefore, the sheet processing apparatus not only separates the obtained image of each sheet, without pulling and dragging the conveying sheets so as to affect the conveying stability of the sheets, but also reduces the load of the stepping motors, improving the quality and efficiency of processing the sheets.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

For instance, the pick roller and the separating roller can be replaced with other components, such as belt pulleys, for functioning as feeding the sheets, and should not be limited. The function of the paper sensor, detecting whether there are the sheets on the stacking plate, is able to achieve via monitoring the light intense of the image signal received by the speed sensor, which reduces the cost of the sheet processing apparatus and simplifies the assembly. In the second embodiment, the time disc may be coated with reflecting-light material and absorbing-light material alternately. The LED and the receiver are both disposed at the same side of the time disc. When the time disc is driven to rotate with the roller, the light from the LED is absorbed or reflected by the time disc. The receiver receives the separated reflected light and generates two corresponding signals transmitted to the signal processing device, for informing that the lowermost sheet is moving. Herein, the stacking plate can be adjusted to lay at a large incline to the horizontal plane, the first pick spring, the second pick spring and the pick roller can be removed because the plural sheets have the gravity functioned as the pressing force from the first and second pick springs and feeding force from the pick roller, decreasing the manufacture cost and simplifying the assembly.

What is claimed is:

1. A sheet processing apparatus adapted for processing a plurality of sheets, comprising:

a sheet-table unit for holding the sheets;

a sheet-separating unit disposed at a downstream end of the sheet-table unit along a convey direction of the sheets, for separating the sheets one by one and feeding the sheets downstream;

a convey unit arranged at a downstream end of the sheet-separating unit along the convey direction of the sheets, for feeding the sheets downstream stably;

a discharge unit located at a downstream end of the convey unit along the convey direction of the sheets, for discharging the sheets;

a sheet processing unit placed between the convey unit and the discharge unit, and close to a convey path of the sheets, for processing the sheets;

a speed sensor arranged at an upstream end of the sheet-separating unit, and close to the convey path, the speed sensor capable of detecting the leaving time of each sheet therefrom, and sending corresponding signal to a system controller which controls the sheet-separating unit to stop and start feeding the sheets, for forming a sheet interval between the two adjacent sheets on the convey path; and an edge sensor located between the sheet-separating unit and the sheet processing unit, the edge sensor capable of detecting a front edge and a rear edge of each sheet passing therethrough, and sending corresponding control signals to the system controller which delays a predetermined time according to the received signals from the edge sensor to control the sheet processing unit to start and stop processing each sheet which is moving on the convey path at an even speed.

2. The sheet processing apparatus as set forth in claim 1, wherein the speed sensor comprises an illumination for illuminating the closest sheet, a lens for collecting the light reflected from the sheet, an image sensor for recording images on the sheet, and a micro processing unit for processing the images from the image sensor to determine the moving velocity of the sheet, and sending corresponding information to the system controller.

3. The sheet processing apparatus as set forth in claim 1, wherein the speed sensor comprises a roller located beneath the convey path and rotated by the conveying sheet, a time disc rotated with the roller, a photo interrupter sensor and a signal processing device.

4. The sheet processing apparatus as set forth in claim 3, wherein the photo interrupter sensor has an LED mounted at one side of the time disc, and a receiver disposed at the other side of the time disc, the time disc is made from lightproof material and fixed at an end of the roller, a plurality of openings is ring-likely formed on the time disc and arranged at equal intervals, one of which is arranged in alignment with the LED and the receiver for allowing light emitted from LED to pass therethrough for generating two alternate signals by the receiver to transmit to the signal processing device.

5. The sheet processing apparatus as set forth in claim 1, wherein the sheet-table unit has a stacking plate, and at least one pick spring, the stacking plate is disposed obliquely for holding the sheets, the at least one pick spring is arranged to press the sheets for guiding the sheets to reach the sheet-separating unit smoothly.

6. The sheet processing apparatus as set forth in claim 5, further comprising a pick roller mounted in the stacking plate and feeding the sheets towards the sheet-separating unit.

7. The sheet processing apparatus as set forth in claim 1, wherein the sheet-separating unit has a separating roller and a retard roller, with a nip area formed therebetween, a friction coefficient between the separating roller and the sheet is larger than that between the retard roller and the sheet, for feeding the sheet downstream, the friction coefficient between the retard roller and the sheet is larger than that between the two adjacent sheets, for stopping other sheets from moving with the picked sheet.

8. A sheet processing method, comprising the steps of:

separating and transporting a plurality of sheets placed on a sheet-table unit one by one along a convey path at an even speed by a sheet-separating unit;

detecting the time at which a front edge of each sheet activates an edge sensor and sending a corresponding signal to the system controller by the edge sensor;

receiving the signal sent by the edge sensor when the front edge of the sheet activates the edge sensor and calculating the time of the sheet arriving at a sheet processing unit on the basis of the received signal, and then controlling the sheet processing unit to start processing the sheet at the time by the system controller;

detecting the time of each sheet leaving a speed sensor and sending a corresponding signal to a system controller by the speed sensor;

calculating the time of the proceeding sheet departing from the sheet-separating unit on the basis of the received signal from the speed sensor, and then controlling the sheet-separating unit to stop feeding succeeding sheets forward and operate again at proper times by the system controller;

detecting the time of a rear edge of each proceeding sheet apart from the edge sensor and sending a corresponding signal to the system controller by the edge sensor;

receiving the signal sent by the edge sensor when the rear edge of the sheet departs from the edge sensor, and calculating the time of the sheet leaving from the sheet processing unit on the basis of the received signal, and controlling the sheet processing unit to stop processing at the time by the system controller; and discharging the proceeding sheet by a discharging unit commanded by the system controller.

9. The sheet processing method as set forth in claim 8, wherein the sheet-separating unit has a separating roller and a retard roller, the separating roller is rotated at an outer peripheral linear speed V1, a length between a pressing point of a sensor arm of the edge sensor and a processing line of the sheet processing unit is designated L, the system controller controls the sheet processing unit to start processing when the front end of the sheet reaches the processing line of sheet processing unit after a substantially time course L/V1.

10. The sheet processing method as set forth in claim 9, wherein a length between the speed sensor and a nip area center of the sheet-separating unit is designated Q, the system controller controls the separating roller to stop rotating after an approximate time Q/V1, when the rear edge of the sheet is apart from the speed sensor.

11. The sheet processing method as set forth in claim 8, wherein the discharge unit has a discharge roller rotated at the speed V1, a discharge pulley and a discharge tray, a length from a processing line of the sheet processing unit to a center of the engagement between the discharge roller and the discharge pulley is designated P, the system controller controls the discharge roller to stop rotating, when a last sheet, with a rear end thereof located at the processing line of the sheet processing unit, is released from the discharge roller and the discharge pulley after an approximate time P/V1.

* * * * *